US006764199B2

(12) United States Patent
Hess

(10) Patent No.: US 6,764,199 B2
(45) Date of Patent: Jul. 20, 2004

(54) LIGHT DISTRIBUTOR, LIGHTING DEVICE COMPRISING AT LEAST ONE LIGHT DISTRIBUTOR AND METHOD FOR THE PRODUCTION OF A LIGHT DISTRIBUTOR

(75) Inventor: Jean-Marc Hess, Münchenstein (CH)

(73) Assignee: Regent Beleuchtungskorper AG, Basel (CH)

( * ) Notice: Subject to any disclaimer, the term of this patent is extended or adjusted under 35 U.S.C. 154(b) by 0 days.

(21) Appl. No.: 10/289,381

(22) Filed: Nov. 7, 2002

(65) Prior Publication Data

US 2003/0099107 A1 May 29, 2003

(30) Foreign Application Priority Data

Nov. 23, 2001 (CH) ..... 2160/01

(51) Int. Cl.[7] ..... F21V 7/00
(52) U.S. Cl. ..... 362/290; 362/342
(58) Field of Search ..... 362/290, 291, 362/342, 217, 260, 346, 354, 325, 347, 364, 365

(56) References Cited

U.S. PATENT DOCUMENTS 6,273,592 B1 * 8/2001 Herst et al. ..... 362/342
2001/0048599 A1 12/2001 Hess

FOREIGN PATENT DOCUMENTS

JP 5-266707 A 10/1993
JP 10-125125 A 5/1998

OTHER PUBLICATIONS

Hess, European Patent Abstract No. 1 154 200. (Nov. 14, 2001).

* cited by examiner

*Primary Examiner*—Alan Cariaso
*Assistant Examiner*—Guiyoung Lee
(74) *Attorney, Agent, or Firm*—Venable LLP; Catherine M. Voorhees

(57) ABSTRACT

A lighting device has a light source and a light distributor comprising a lamella grid or, more precisely, a reflective lamella grid. This has two strips parallel to one another and a row of lamellae which are arranged between said strips and, together with the two strips, consist of a single sheet-metal piece. Each lamella has a web and one or two limbs associated with this. Each web is furthermore associated with the two strips. The light distributor furthermore has two lateral walls which serve as lateral reflectors and are formed either by lateral sections of the sheet-metal piece forming the reflective lamella grid or by two originally separate parts connected to the reflective lamella grid. The reflective lamella grid can be produced economically from an originally flat sheet-metal piece with little work.

43 Claims, 7 Drawing Sheets

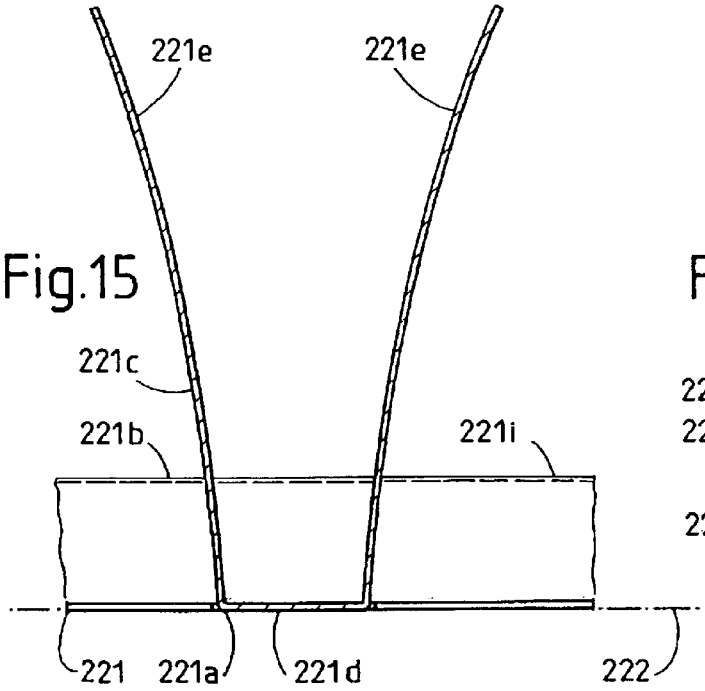
Fig.15
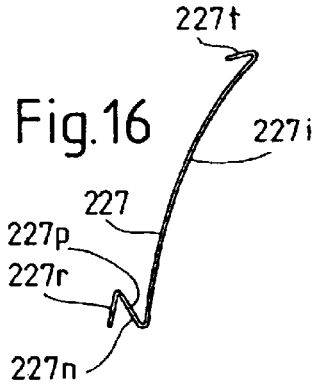
Fig.16
Fig.17
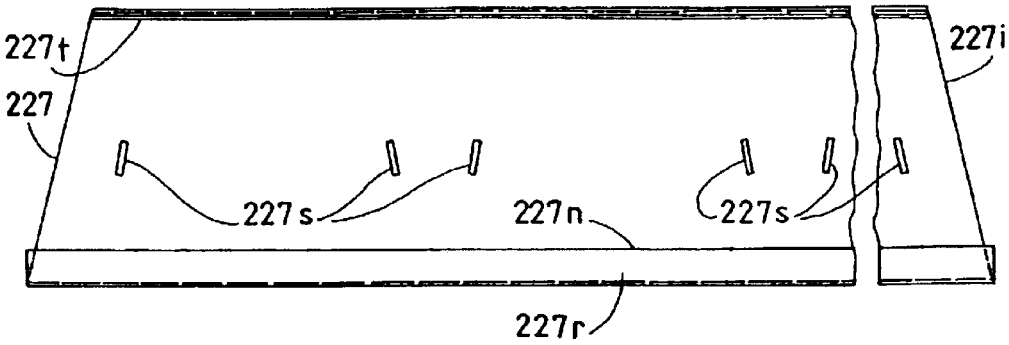

LIGHT DISTRIBUTOR, LIGHTING DEVICE COMPRISING AT LEAST ONE LIGHT DISTRIBUTOR AND METHOD FOR THE PRODUCTION OF A LIGHT DISTRIBUTOR

BACKGROUND OF THE INVENTION

1. Field of the Invention

The invention relates to a light distributor for a lighting device, comprising two strips parallel to one another, lamellae arranged between said strips, connected to them and transverse to them, and holes present between said lamellae. Light distributors of this type are also referred to as reflector grids in practice.

2. Description of the Prior Art

A lighting device having at least one such light distributor may consist, for example, of a light, such as a ceiling light fastened directly and firmly to the ceiling, or a pendant, built-in, standard or wall light, which has an artificial light source having at least one electric lamp, for example at least one straight, tubular and/or U-shaped fluorescent lamp. The lighting device may, however, also be in the form of a luminous-band lighting device which has a rail and at least one row of lamps which follow one another along said rail and, for example, in turn consist of tubular and/or U-shaped fluorescent lamps. The lighting device is provided in particular for use in a room, for example a large office, in which at least one person works at a screen.

Known light distributors of this type have two strips, each consisting of a longitudinal wall, and a large number of lamella, each strip and each lamella consisting of a separate sheet-metal part. The strips have at least one hole for each lamella. In each of the two strips, each lamella has at least one fastening section which passes through a hole in the relevant strip and is fastened there by being bent over or locked on the strip. These known light distributors have the disadvantage that a large number of separate parts has to be produced for each light distributor. Furthermore, however, lamellae have to be arranged at the intended position between the two strips and then fastened to the strips. The production of the strips and lamellae and the assembly of these to give a light distributor are therefore complicated and expensive.

US 2001/0 048 599 A1 and the corresponding EP 1 154 200 A2 disclose light distributors having an extensive, flat or slightly curved main section which has a number of round holes and, for each of these, a projecting collar completely enclosing the hole and tapering toward the light source. These light distributors can be produced with a small height and have already proven useful but have the disadvantage that the extensive main section between the round holes and collars still has relatively large regions opaque to light. This reduces the proportion of light radiated by the lamp or the lamps of the light source directly through the holes of the light distributor, based on the total light radiated from the light source to the light distributor.

SUMMARY OF THE INVENTION

It is an object of the invention to provide a light distributor which overcomes the disadvantages of the known light distributors. The light distributor should in particular be capable of being produced economically and should have light passages which occupy as large a part as possible of the total area of the light distributor section having light passages, so that a large proportion of the light radiated by the light source to this section of the light distributor can be radiated through the light passages.

This object is achieved according to the invention by a light distributor for a lighting device comprising at least one row of lamellae which is arranged between two strips parallel to one another and each of which has two end lamellae each arranged at one end of said row and inner lamellae arranged between said end lamellae, the strips and lamellae together consisting of a single sheet-metal piece, each lamella having a web associated with the two strips and at least each inner lamella having two limbs which are opposite one another, are associated with the web of the relevant lamella and are at least one of angled and curved away from the web.

It is also an object of the invention to provide a lighting device comprising at least one light distributor of the above-mentioned type, the lighting device having at least one lamp holder for holding at least one electric lamp of a light source in such a way that the light source radiates through the light distributor during operation.

According to still another object of the invention, a method for the production of a light distributor of the above-mentioned type is provided, in which a flat sheet-metal piece having incisions and/or holes is provided for bounding, for each limb, two lateral limb edges facing away from one another and an end limb edge, the limbs bounded thereby being angled relative to the webs.

BRIEF DESCRIPTION OF THE DRAWING

The subject of the invention is explained below with reference to the embodiments shown in the drawings. In the drawings, FIG. 15 shows a cut-out from FIG. 13, on a larger scale, FIG. 16 shows an end view of a side element of the light distributor according to FIG. 11 and FIG. 17 shows a side view of the side element, which side view is viewed from the left side of FIG. 16.

DESCRIPTION OF THE PREFERRED EMBODIMENTS

Figure 1:
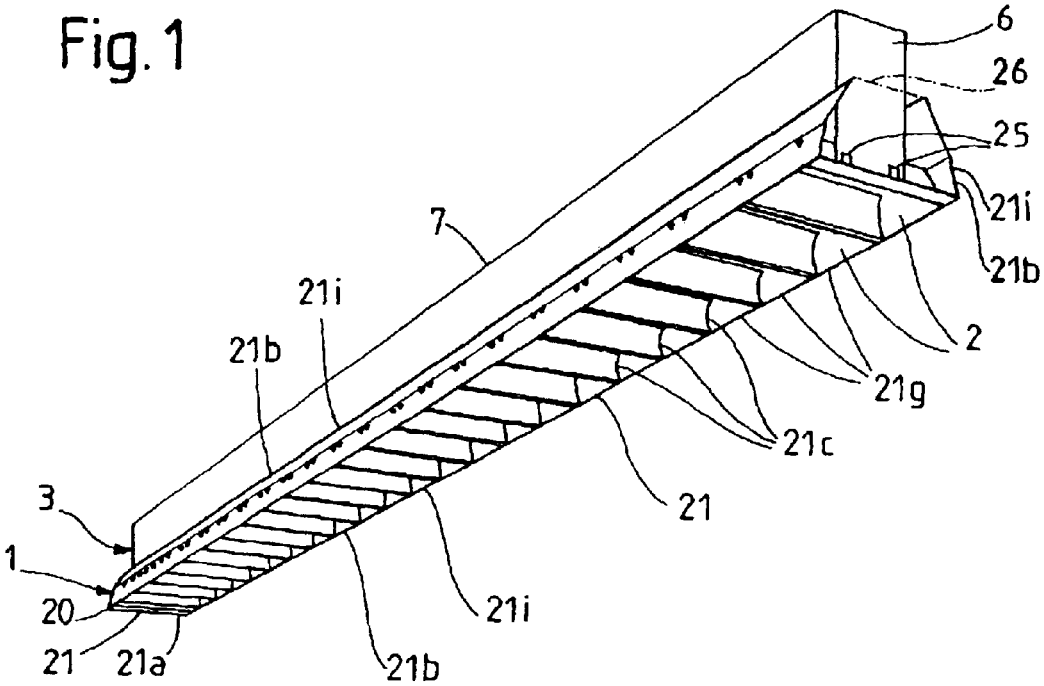
FIG. 1 shows a perspective view of a lighting device comprising a light distributor having lamellae.
Figure 2:
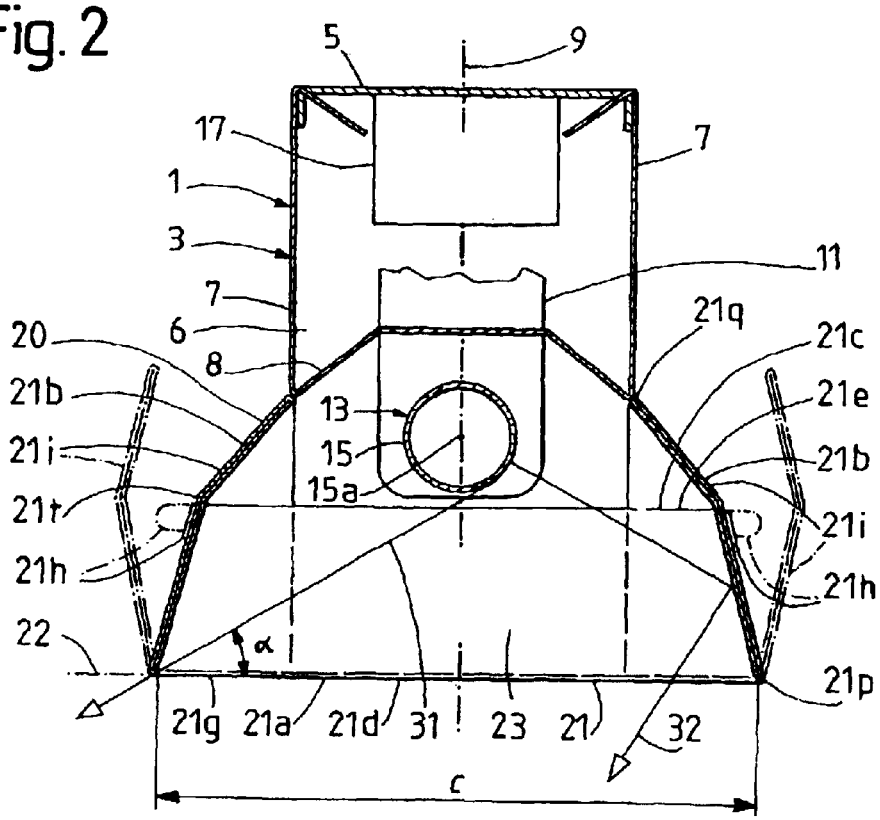
FIG. 2 shows a schematic cross-section of the lighting device, which cross-section passes between lamellae.

The lighting device 1 shown in FIGS. 1 and 2 consists of a light and has a housing 3 which is shown in only slightly simplified form and is held by retaining means on a room ceiling of a room of a building. The housing can, for example, be directly adjacent to the surface of the room ceiling and rigidly fastened thereto or suspended by means of flexible cables, chains or the like from the room ceiling in a movable manner a distance away from said ceiling, or may be at least partly let into a hole in the room ceiling. The housing 3 is elongated and has, for example, a base 5 and four flat, approximately vertical walls, namely two end walls 6 and two lateral walls 7 running in the longitudinal direction of the housing. The housing furthermore has a top reflector 8 which is connected to the lower edges of the two lateral walls 7 and, for example together with the lateral walls, consists of a single cohesive, multiply angled sheet-metal piece and a reflects light well and is metallized on its lower side. The housing 3 is substantially symmetrical with respect to a vertical central plane 9 in a longitudinal direction.

The housing 3 contains and holds at least one lamp holder 11, namely, for example, two lamp holders 11 located opposite one another, arranged in the vicinity of the end walls 6 and fastened to said end walls and/or to the base 5. The housing furthermore contains an artificial, electric light source 13 comprising an electric lamp 15, namely a tubular, straight, horizontal fluorescent lamp which is parallel to the lateral walls 7 and held detachably by the two lamp holders 11 and whose straight, horizontal lamp axis 15*a* is in the vertical central plane 9 below the lower edges of the lateral walls 7. The housing 3 furthermore contains and holds a ballast 17, for example an electronic one.

Figure 4:
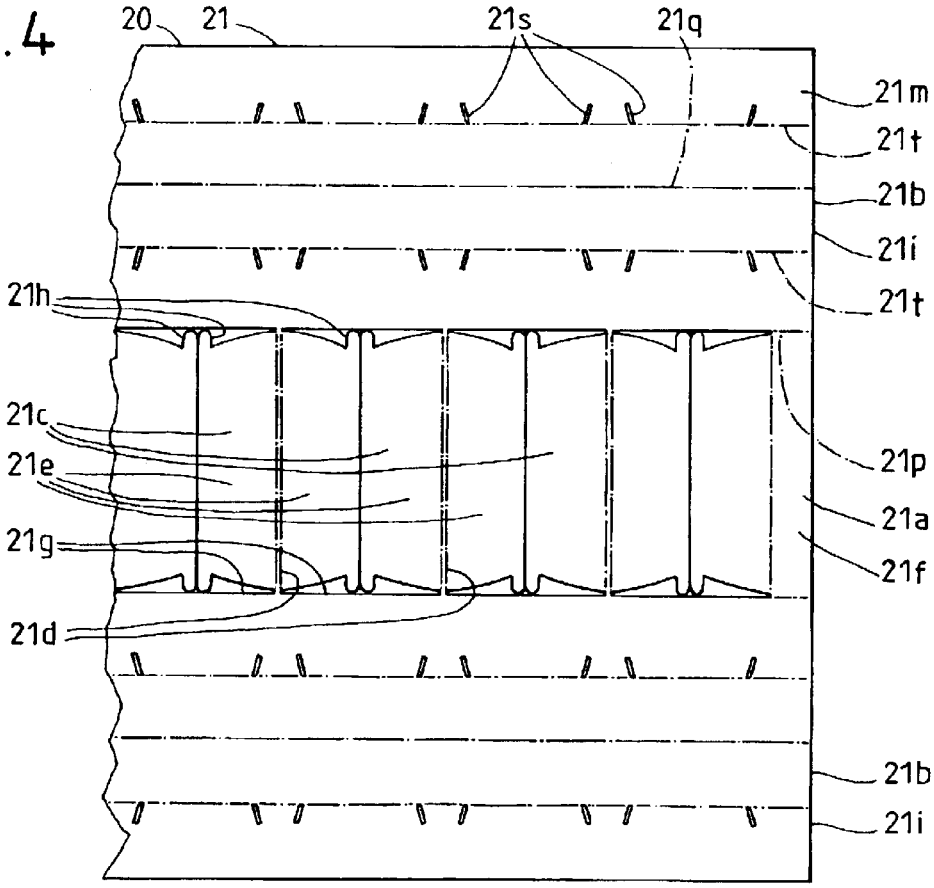
FIG. 4 shows a plan view of a flat sheet-metal piece for forming the light distributor.
Figure 5:
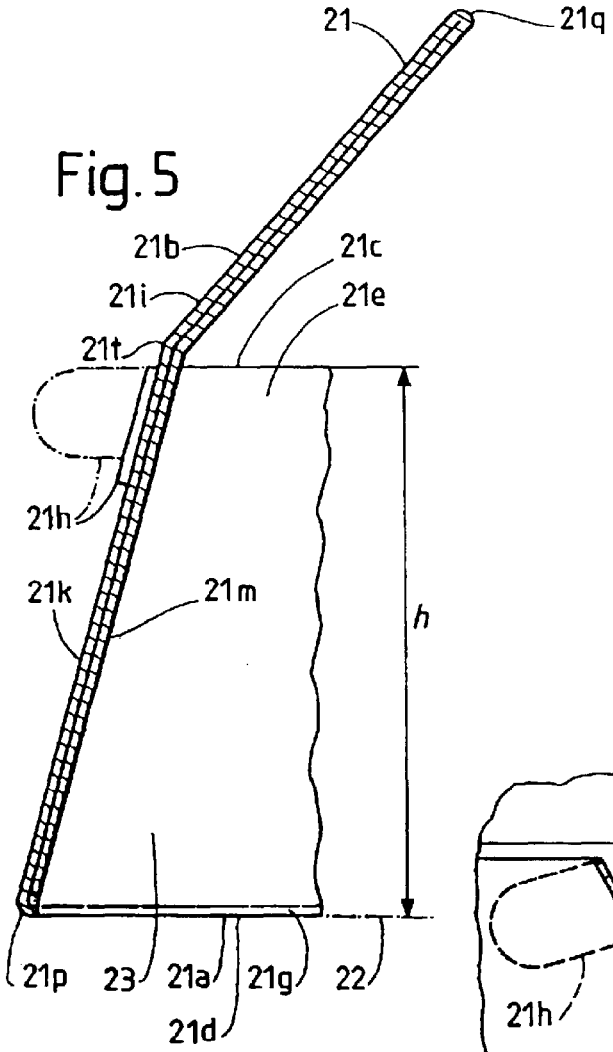
FIG. 5 shows a cut-out from FIG. 2, on a larger scale.
Figure 6:
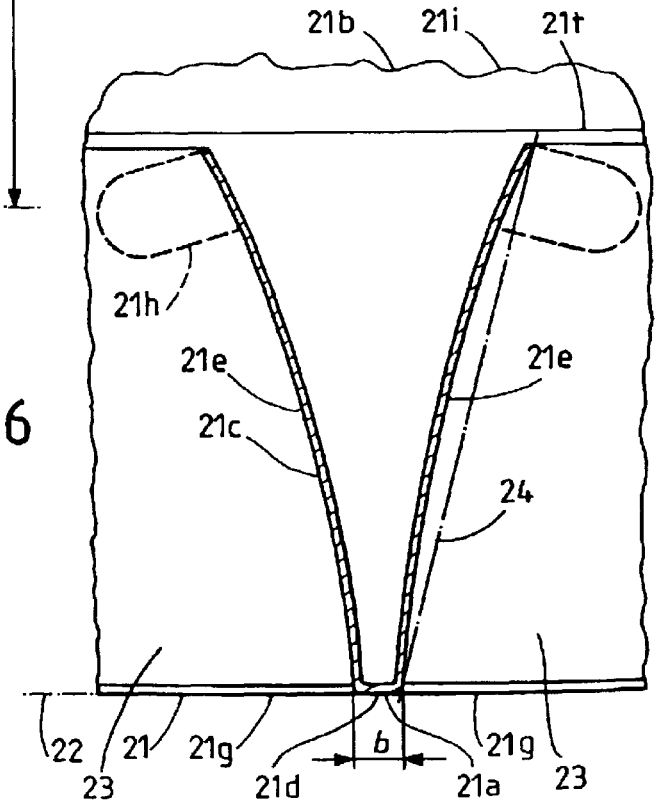
FIG. 6 shows a cut-out from FIG. 3, on a larger scale.

A light distributor 20 is arranged on the lower side of the housing 3 and detachably fastened to it. The light distributor 20 is formed by a lamella grid or, more precisely, reflective lamella grid 21. The light distributor 20 or reflective lamella grid 21 consists of a single, continuous, i.e. integral, multiply angled sheet-metal piece and is also shown together with the lamp 15 in FIG. 3 and in the flat, unwound state separately in FIG. 4. Furthermore, sections of the light distributor are shown in FIGS. 5 and 6. The light distributor 20 or reflective lamella grid 21 has a middle section 21*a* and two lateral strips 21*b* running on opposite sides of said middle section and along the latter. The middle section 21*a* and the two strips 21*b* are elongated and are parallel to the longitudinal direction of the housing 3 and to the lamp axis 15*a*. The middle section 21*a* has a number of lamellae 21*c* which form a straight row of lamellae which is parallel to the longitudinal directions of the housing 3 and of the lamp 15. In plan view, the individual lamellae 2*k* are transverse, namely at right angles, to the strips 21*b*. The lamellae 21*c* which are not located at one of the two ends of the row of lamellae are referred to below as inner lamellae. Each of these inner lamellae has an inner, elongated web 21*d* and two limbs 21*e*. Each inner web 21*d* is associated at its two web ends with one of the strips 21*b* and at its two longitudinal or lateral edges, running transverse and namely at right angles to the row of lamellae, with one of the limbs 21*e*. The lamellae located at the two ends of the row of lamellae and their webs are referred to below as end lamellae 21*c* and end webs 21*f*, respectively. Each end lamella has, for example, only a single limb 21*e* associated with the end web 21*f*. The end webs 21*f* have, for example, a larger dimension or width, measured in the longitudinal direction of the row of lamellae, than the inner webs 21*d* and are likewise associated, at their web ends extending in the direction of the row of lamellae, with the strips 21*b*. The webs 21*d*, 21*f* following one another along the row of lamellae, in pairs together with those edges of the strips 21*b* which face the middle section 21*a*, bound light passages 21*g*. Each limb 21*e* has two lateral limb edges which face away from one another and run away from the webs 21*d* or 21*f* associated with the limb. Each limb 21*e* furthermore has an end limb edge which is located at the upper free limb end which faces away from the web associated with this limb. The end limb edge is straight and parallel to the longitudinal direction of the webs. In the unwound, flat state of the sheet-metal piece forming the light distributor 20 or reflective lamella grid 21, the main sections of the lateral limb edges forming the greatest part of said edges are inclined toward one another and away from the relevant web and, for example according to FIG. 4, are smooth and slightly convex, but might instead also be straight for the most part. At least some of the limbs 21*e* and namely, for example, each limb of each lamella have or has, at its lateral limb edges in the vicinity of the end limb edge, in each case a fastening section 21*h*, namely a fastening lug 21*h*, which projects away from the main section of the relevant lateral edge toward the side.

The lower surfaces of the webs 21*d*, 21*f* together define a web plane 22 which, in the case of a lighting device fastened to an approximately horizontal room ceiling, forms the lower boundary of the light distributor 20 and is approximately or exactly horizontal. Each strip 21*b* has a lateral section 21*i* which forms a two-layer, lateral wall 21*i* and serves as a lateral reflector likewise denoted by 21*i*. The limbs 21*e* of the lamellae 21*c* and the walls 21*i* project, in a manner described in more detail, toward the same, namely upper side of the web plane 22, away from the latter, toward the base 5 of the housing 3. Each of the two lateral walls 21*i* has a first, outer wall section 21*k* and a second, inner wall section 21*m*. As shown particularly clearly in FIG. 5, the first, outer wall section 21*k* is associated, at a first, lower wall edge 21*p*, via angled, edge-like and/or curved connecting sections, with one end of the inner webs 21*d* and end webs 21*f*. Furthermore, each first, outer wall section 21*k* is associated, at a second, upper wall edge 21*q*, via a fold, with the second, inner wall section 21*m*. The second wall section 21*m* of each of the two walls 21*i* runs away from the second, upper wall edge 21*q*, along that side of the first wall section 21*k* which faces the other, opposite wall, toward the webs 21*d*, 21*f* up to at least approximately the first, lower wall edge 21*p* and is at least approximately adjacent, at least in parts and preferably substantially everywhere, to the first wall section 21*k*, so that the two wall sections 21*k*, 21*m* form an outer and inner layer, respectively, of the wall. Each of the two wall sections 21*k*, 21*m* of the two walls 21*i* has a slot-like hole 21*s* for each limb 21*e* of each lamella. The holes 21*s* of the two wall sections 21*k*, 21*m* belonging to the same wall are at least approximately flush with one another in pairs.

The two walls 21*i* are inclined toward one another in an upward direction away from the webs 21*d*, 21*f* and have, for example in vertical section, two flat wall parts which are connected to one another approximately to the height of the upper ends of the limbs 21*e* or slightly above these ends by a slightly angled and/or curved transition 21*t*. The wall parts located above the transitions 21*t* are inclined upward toward one another to a slightly greater extent than the wall parts located below the transitions 21*t* and thus make a slightly smaller, more acute angle with the web plane 22 than the lower wall parts. The inner surfaces of the wall parts associated at the transition 21*t* accordingly make an obtuse angle with one another. Otherwise, at their second upper wall edges 21*q* the walls 21*i* abut—at least approximately—the edges of the main housing part 7, at which the top reflector 8 is connected to the lateral walls 7. According to FIG. 2, the top reflector 8 has, in cross-section, three flat sections, namely a middle reflector section parallel to the web plane 22 and located above the lamp 15 and, on both sides of said reflector section, two lateral, inclined reflector sections. The two lateral reflector sections are inclined upward toward one another away from the lower edges of the lateral walls 7 and the second, upper wall edges 21*q* of the light distributor 20 to an even slightly greater extent than the upper wall parts of the walls 21*i*. The lower surface of the top reflector 8 and the inner surfaces of the walls 21*i* serving as lateral reflectors, which surfaces face in each case the other wall 21*i*, together form a light-reflecting, mirror surface which, in the vertical cross-section shown in FIG. 2, is multiply angled and more or less concave.

As shown in FIGS. 2 and in particular 5, the first, lower edges 21*p* of the walls 21*i* are located virtually directly at the free ends of the webs 21*d* and those edges of the light passages 21*g* which run in the longitudinal direction of the light distributor 20 and of the row of lamellae. The limbs 21*e* of the lamellae 21*c* rest with the smooth main sections of their lateral edges at least approximately against the walls 21*i*. The fastening sections or fastening lugs 21*h* of the limbs pass through the holes 21*s* approximately flush with one another in pairs and present in the wall sections 21*k*, 21*m* and are angled on the outer side facing away from the remaining parts of the limbs, so that they are adjacent to the outer surfaces of the first, outer wall sections 21*k* of the walls 21*i* and connect the limbs of the lamellae there firmly to the walls. The lamellae are thus associated on the one hand, at their lowermost points at the ends of their webs, with the two strips 21*b* and are moreover firmly connected, in the vicinity of the uppermost point of their limbs, by the fastening sections or fastening lugs 21*h*, to the walls 21*i* formed by lateral sections of the strips 21*b*. For these reasons and owing to the two-layer formation of the walls 21*i*, the light distributor 20 or reflective lamella grid 21 is fairly stable and dimensionally stable even when the sheet-metal piece forming it has a small sheet-metal thickness.

Each limb 21*e* of a lamella 21*c* is in general inclined away from the web 21*d* or 21*f* associated with it, upward toward the lamella adjacent to it along the row of lamellae. The limbs are slightly curved in the vertical section shown in FIGS. 3 and 6, in such a way that the opposite surfaces of two limbs belonging to lamellae adjacent to one another are concave and, for example, approximately parabolic. The two limbs 21*e* belonging to one and the same inner lamella 21*c* are accordingly inclined upward away from one another in a direction away from the web 21*d* of the relevant lamella.

An intermediate light transmission space 23 is present between two directly adjacent limbs 21*e* of two different lamellae following one another along the row of lamellae. In the vertical cross-section shown in FIG. 2 and running transverse to the row of lamellae, said space 23 is bounded by the two walls 21*i* which are at least approximately adjacent to the lateral limb edges of the lamellae over the total height of the lamellae. In this embodiment of the light distributor, each intermediate light transmission space 23 thus forms a light passage which is more or less closed on all sides in plan view and in horizontal sections and extends downward away from the light source 13 toward the webs 21*d*, 21*f*, both in the cross-section shown in FIG. 2 and running vertically and transversely to the row of lamellae and in the longitudinal section shown in FIG. 3 and running vertically and in the longitudinal direction of the row of lamellae.

The thickness of the sheet-metal piece forming the light distributor 20 or reflective lamella grid 21 is preferably at most 1 mm and, for example, about 0.3 mm to 0.5 mm. The dimensions of the light passages 21*g* measured in the longitudinal direction of the light distributor 20 and of the row of lamellae—i.e. the distance between the opposite lateral edges of two webs 21*d* and 21*d* or 21*d* and 21*f* adjacent to one another—is denoted by a in FIG. 3. This dimension a may vary within wide limits and is typically at least 15 mm, at most 100 mm and, for example, 20 mm to 60 mm. The inner webs 21*d* have a dimension or width, measured in the longitudinal direction of the light distributor 21 and of the row of lamellae, which is denoted by b in FIGS. 3 and 6. This dimension or width b of the inner webs is expediently at most 10 mm, preferably at most 8 mm, better at most 6 mm and preferably at least 1 mm and, for example, 2 mm to 5 mm or 6 mm. The width b of the inner webs 21*d* is furthermore expediently at most 25%, preferably at most 20%, better at most 15% and, for example, even only at most or about 10%, of the dimension a of the light passages. That dimension of the light passages 21*g* which is measured at right angles to the row of lamellae and is denoted by c in FIG. 2 is preferably at least of the same magnitude as the dimension a of the light passages and, for example, 30% to 100% greater than the dimension a. The height h of the lamellae 21*c* or, more precisely, of the limbs 21*e* of the latter, measured perpendicular to the web plane 22, is, for example, 40% to 60% of the dimension a of the light passages 21*g*. The lateral sections 21 or lateral walls 21*i* serving as lateral reflectors have a height $h_1$, measured perpendicular to the web plane 22, which is at least equal to the height h of the lamellae and namely greater than the height h, so that the lateral walls 21*i* or lateral reflectors project beyond the limbs of the lamellae. The lower and upper edges of a limb 21*e* which are adjacent to an intermediate light transmission space 23 together define a limb plane which is shown in FIG. 6 and denoted by 24 and makes an angle of, for example, about 70° to 80° with the web plane 22.

The light distributor 20 or reflective lamella grid 21 is detachably connected to the housing 3 by fastening means 25 indicated only schematically in FIG. 1. The fastening means 25 may have, for example, fastening members which are connected permanently to the housing 3 or light distributor 20 and can snap into one another and/or can be firmly clamped to one another and/or can be in the form of fast-action locking parts or can possibly be screwed to one another so that, for replacing the lamp 15, the light distributor can be rapidly removed from the housing and fastened thereto again. The fastening members connected permanently and firmly to the light distributor 20 may consist completely or partly of holes present in the light distributor and/or lugs associated with the light distributor, or the like. If the light distributor is fastened to the housing, it is likewise substantially symmetrical with respect to the central plane 9. The housing may furthermore be provided, at each of its two ends, with an end closure member 26 which is likewise indicated only schematically in FIG. 1 and encloses the light distributor at the ends. The end walls 6, the reflector 8, the light distributor 20 and the end closure members 26 together bound a light source chamber which contains the light source 13 and from which light can be radiated into the environment substantially only through the intermediate light transmission spaces 23 of the light distributor 20 and which is otherwise more or less opaque to light.

For the production of a light distributor 20 or reflective lamella grid 21, a flat sheet-metal piece at least generally rectangular is first produced and, for example, provided with the cuts or slot-like holes shown in FIG. 4 by punching. In particular, two lateral limb edges facing away from one another and an end limb edge are formed or bounded for each limb 21*e* of a lamella 21*c*. The end limb edges can be formed by cuts without removal of material so that the limbs of lamellae adjacent to one another more or less abut one another in the flat state of the light distributor or sheet-metal piece. On the other hand, a small amount of material is removed, namely punched out, in the case of the lateral limb edges, so that approximately triangular holes and fastening sections 21*h* form there in the sheet-metal piece. Furthermore, the slot-like holes 21*s* are punched into the sheet-metal piece. Moreover, the sheet-metal piece may also be provided, by embossing in the flat state, with grooves at which it is subsequently angled and/or folded. In any case starting from the originally flat sheet-metal piece the wall sections 21*k*, 21*m* are folded for the formation of the two-layer walls 21*i* and the limbs 21*e* of the lamellae 21*c* and the strips 21*b* or walls 21*i* are angled relative to the webs 21*d*, 21*f*. Furthermore, the fastening sections or fastening lugs 21*a* are introduced into the slot-like holes 21*s* of the walls in the intermediate state indicated by dash-dot lines in FIGS. 2 and 5, during final shaping of the walls 21*i* likewise indicated by dash-dot lines in an intermediate position in FIG. 2. Thereafter, the fastening sections or fastening lugs 21*h* are angled so that they occupy the positions which are drawn with solid lines in FIGS. 2 and 5 and also shown in FIGS. 1, 3 and 6 and in which they are adjacent to the outer surfaces of the walls. In this way, the light distributor 20 can be produced economically from a single sheet-metal piece in a short time and with little work.

The light distributor 20 or reflective lamella grid 21 consists, for example, of aluminum or of an aluminum alloy. The sheet-metal piece forming the light distributor has a smooth and light-reflecting, mirrored surface, for example on both sides. During the production of the sheet-metal piece, one of these two surfaces can be made particularly light-reflecting and with particularly good mirror properties by a particular surface treatment—for example by anodization and coating of the anodized surface layer with a very thin, very light-transparent protective layer. This specially treated, highly reflective surface then has better light reflectivity and better mirror properties than the other surfaces of the sheet-metal piece. For clarification, it should be noted that "mirror properties" means that light incident on the surfaces is reflected in accordance with the optical laws of reflection and not radiated back diffusely. In the formation of the light distributor 20 from an originally flat sheet-metal piece, the latter is shaped, i.e. angled and curved, in such a way that those surfaces of the limbs 21*d* of the lamellae which are adjacent to the intermediate light transmission spaces 23 are formed by sections of the highly reflective or better light-reflecting surface of the sheet-metal piece. This highly reflective surface then also forms the lower surfaces of the webs 21*d*, 21*f*, the outer surfaces of the first, outer wall sections 21*k* and especially those inner surfaces of the second, inner wall sections 21*m* which are adjacent to the intermediate light transmission spaces 23.

Figure 3:
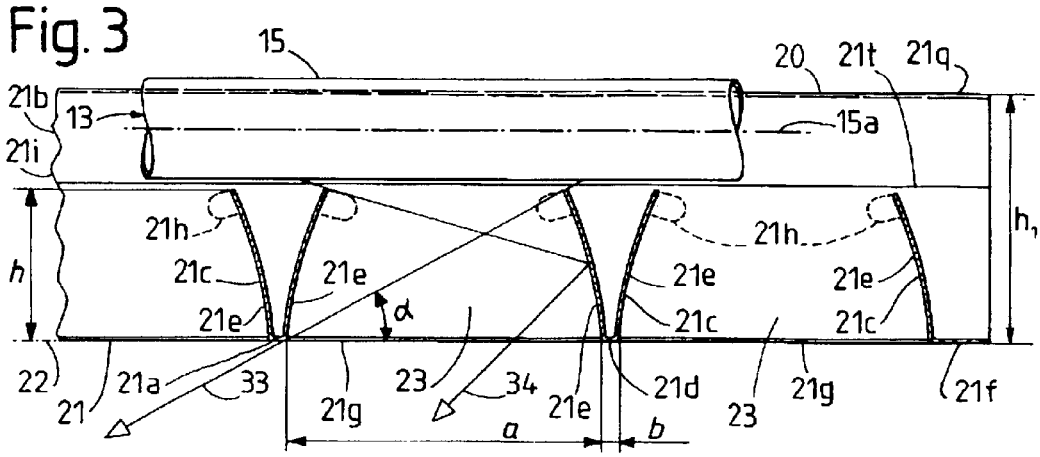
FIG. 3 shows a longitudinal section through sections of the light distributor and of the tubular lamp of the lighting device.

According to FIGS. 2 and 3, the lamp 18 is located above the free upper edges or end edges of the limbs 21*e* of the lamellae 21*c*, a small distance away therefrom. The lamp axis 15*a* and at least the greatest part of the entire lamp 15 are located below the second, upper wall edges 21*q* of the walls 21*i* of the light distributor 20. Those upper, free edges or end edges of the limbs 21*e* of the lamellae which face the lamp 15 together define a flat, rectangular area which is bounded on its longitudinal sides by the walls 21*i* of the light distributor 20 and is referred to below as the light incidence side and/or light incidence area of the middle section 21*a*, of its lamellae and of the entire light distributor. The lower surfaces of the webs 21*d*, 21*f*, those lower edges of the limbs 21*e* which are associated with the webs, and the first, lower wall edges 21*p* together form and define a light-radiating side and/or light-radiating area of the middle section 21*a*, of its lamellae 21*c* and of the entire light distributor, which light-radiating side and/or light-radiating area lies in the web plane 22.

When the lighting device 1 is used, the lamp 15 radiates a part of the light generated by it directly toward the light incidence side or light incidence area of the middle section 21*a* and, at this light incidence side or light incidence area, into the intermediate light transmission spaces 23, through the intermediate light transmission spaces 23 and through the light passages 21*g* and, at the latter, out of the light distributor 20 on the light-radiating side of said light distributor. The light passages 21*g* thus form the light emergence orifices of the light distributor. In FIGS. 2 and 3, two light beams of light radiated directly—i.e. without reflection at any surface of the light distributor 20—through the light distributor are shown and are denoted by 31 and 33. Furthermore, light radiated directly from the lamp into the intermediate light transmission spaces 23 can be reflected therein once or several times by at least one surface bounding these intermediate spaces and belonging to at least one of the walls 21*i* and/or to at least one of the limbs 21*e*. As examples of such light, a light beam 32 reflected by one of the walls 21*i* and a light beam 34 reflected by a limb 21*e* of a lamella 21*c* are shown in FIGS. 2 and 3, respectively. The lamp 15 may furthermore radiate light in approximately horizontal directions and/or directions inclined slightly downward relative to a horizontal plane and upward, which light is then reflected above the lamellae 21*c* by the inner surfaces of the walls 21*i* and/or by the lower surface of the top reflector 8 and/or possibly by the end walls 6 and/or other reflectors and/or reflective surfaces of the housing downward toward the light entry side of the light distributor.

The light radiated directly and without reflection and that radiated with at least one reflection by a lamella 21*c* and/or wall 21*i* through an intermediate light transmission space 23 and the light passage 21*g* downward out of the light distributor makes an angle $\alpha$ with the web plane. The intermediate light transmission spaces widen from top to bottom in such a way that this angle $\alpha$ is at least 25° for all possible light beams. Consequently, with an approximately horizontal position of the web plane 22, it is possible to prevent a person working at a screen set up in the usual manner in the room having the lighting device 1 from being dazzled by any light radiated from the lighting device 1 toward the screen and reflected by the latter. The light distributor 20 thus has an antidazzle effect. Furthermore, a large part of the light generated by the lamp and radiated directly or after at least one prior reflection toward the light incidence side of the middle section 21*a* and of the lamellae 21*c* is radiated through these and out of the bottom of the light distributor.

Figure 7:
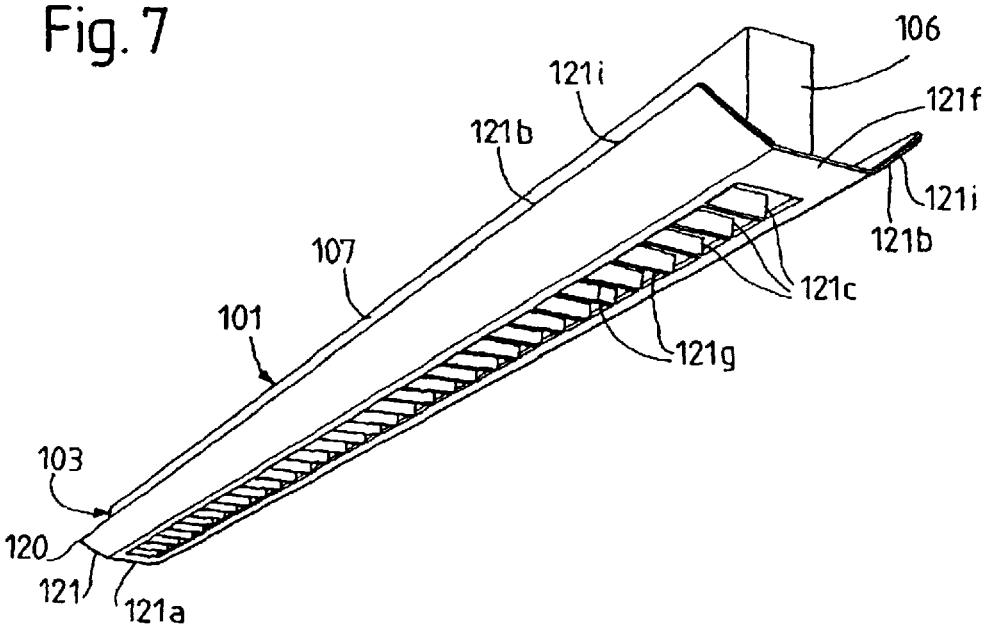
FIG. 7 shows a perspective view of another lighting device.
Figure 8:
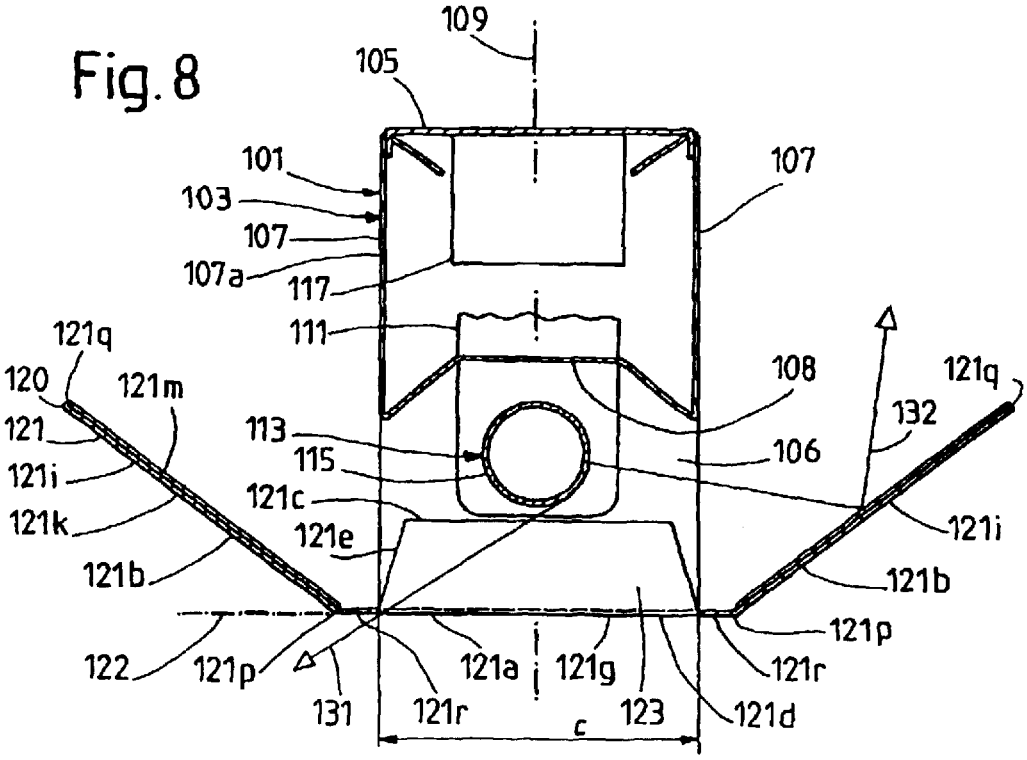
FIG. 8 shows a schematic cross-section of the lighting device according to FIG. 5, which cross-section is analogous to FIG. 2.

The lighting device 101 shown in somewhat simplified form in FIGS. 7 and 8 in turn has a housing 103 comprising a base 105, two end walls 106, two lateral walls 107, a reflector 108 and a vertical central plane 109 running in the longitudinal direction of the housing. The lighting device 101 furthermore has two lamp holders 111, a light source 113 with a tubular lamp 115, a ballast 117 and a light distributor 120 detachably fastened to the housing 103 by fastening means which are not shown.

The light distributor 120 is once again formed by a one-piece lamella grid or, more precisely, reflective lamella grid 121. This in turn has a middle section 121*a* and two strips 121*b* running along its longitudinal sides. The middle section 121*a* in turn has inner lamellae 121*c* with inner webs 121*d* and two limbs 121*e* each and two end lamellae 121*c* with only one limb and one broader end web 121*f*. According to FIG. 9, the limbs 121*e* are inclined analogously to limbs 21*e* but are, for example, flat. Light passages 121*g* are present between the webs 121*d*, 121*f*. The webs or—more precisely—the lower surfaces of these, define a web plane 122. The strips 121*b* have a lateral section 121*i* which forms a lateral wall 121*i* running upward away from the web plane 122. Said wall 121*i* has a first, outer wall section 121*k*, a second, inner wall section 121*m*, a first, lower wall edge 121*p* and a second, upper wall edge 121*q* and once again serves as a lateral reflector 121*i*. In this embodiment, a narrow, strip-like connecting section 121*r* which lies in the same plane as the webs and may be regarded as part of the middle section 121*a* and/or of one of the strips 121*b* is present between the first, lower wall edge 121*p* of each wall 121*i* and those web ends of the webs 121*d*, 121*f* which are opposite this wall edge, and those edges of the light passages 121*g* which run in the longitudinal direction of the light distributor and of the row of lamellae. The width of the connecting sections 121*r*, measured at right angles to the longitudinal direction of the light distributor 120 and of the row of lamellae, is preferably substantially smaller than the dimension c of the light passages 121*g*, likewise measured at right angles to said longitudinal direction, and is preferably at least 2 mm and, preferably, at most 10 mm.

The two walls 121*i* of the light distributor 120 or reflective lamella grid 121 project upward beyond the limbs 121*e* of the lamellae 121*c* and preferably also slightly beyond the lamp 115 but are inclined upward away from the webs and from one another and outward away from the central plane 109. The walls 121*i* are, for example flat and make an angle of, for example, about 30° to 50° with the web plane 122. Free intermediate spaces are present between the walls 121*i* of the light distributor 120 and those outer edges of the top reflector 108 which coincide with the lower edges of the lateral walls 107. Once again, intermediate light transmission spaces 123 are present between the lamellae adjacent to one another. The lateral edges of the limbs 121*e* of the lamellae 121*c* are, however, separated from the two walls 121*i* by free intermediate spaces becoming larger in an upward direction. The intermediate light transmission spaces 123 are therefore no longer completely separated from one another in plan view in the light distributor 120 but are continuous between the lateral edges of the limbs 121*e* and the walls 121*i*.

Figure 10:
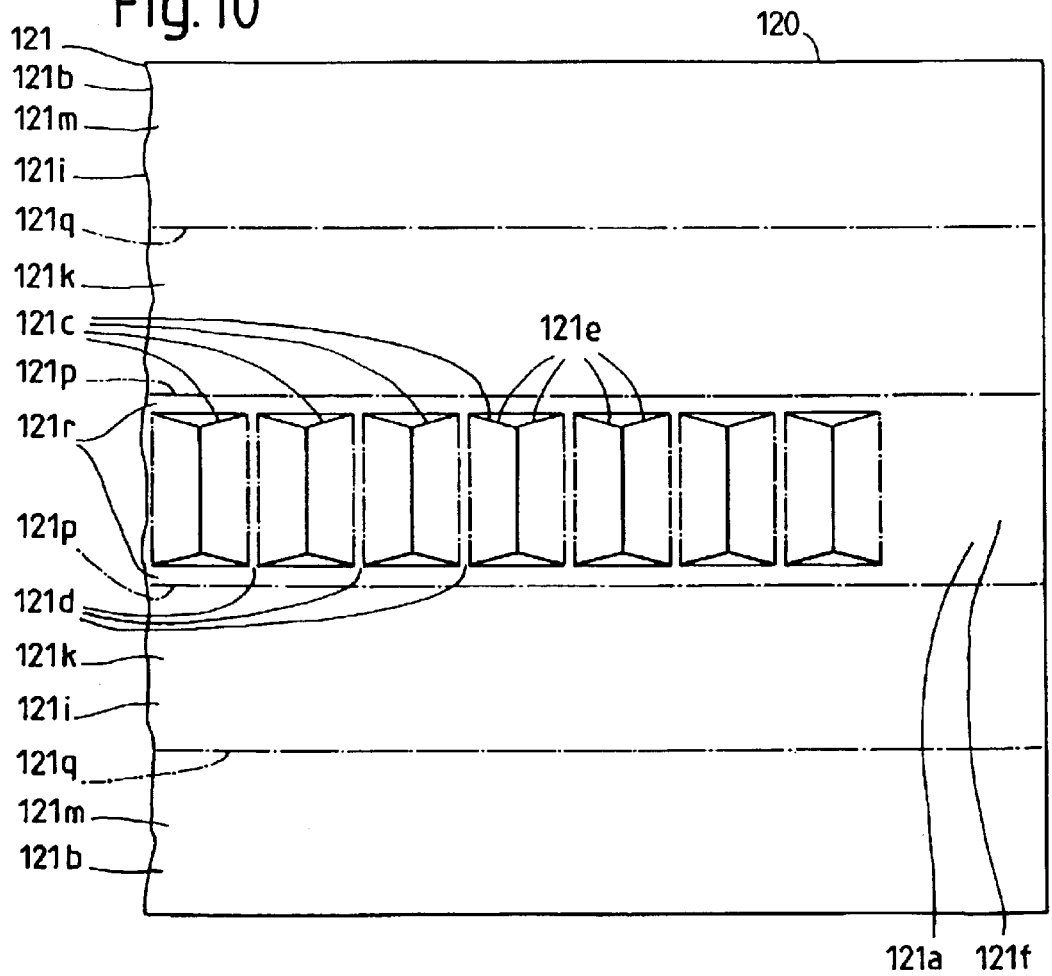
FIG. 10 shows a plan view of a flat sheet-metal piece for forming the light distributor of the lighting device shown in FIGS. 7 to 9.

For the production of the light distributor, a flat, rectangular sheet-metal piece is first formed, provided with the cuts and holes shown in FIG. 10 and then angled.

Figure 9:
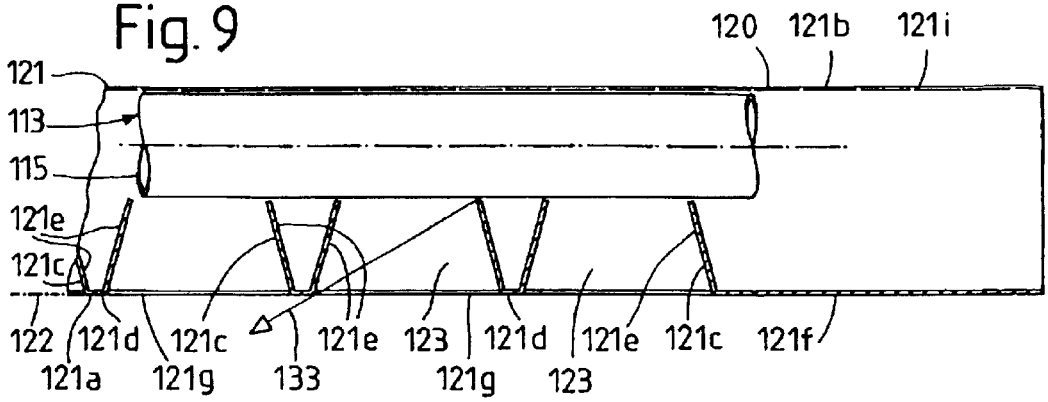
FIG. 9 shows a longitudinal section through sections of the lighting device and of the tubular lamp of the lighting device according to FIGS. 7, 8.

When the lighting device 101 is used, the lamp 115 can, inter alia, radiate light without reflection by the light distributor 120 through its intermediate light transmission spaces 123, as illustrated by the light beams 131 and 133 in FIGS. 8 and 9. Furthermore, light which is reflected by at least one of the limbs 121*e* of the lamellae 121*c* can be radiated through the intermediate light transmission spaces. The lamp 115 can furthermore radiate light toward the inner surfaces of the walls 121*i* of the light distributor 120, which light is then reflected by said light distributor and, like the light beam 132 in FIG. 8, radiated upward toward the room ceiling on which the lighting device 121 is held. The room ceiling can then radiate at least a part of this light more or less diffusely back downward. In addition, the lamp may even radiate light directly between the lower edges of the lateral walls 107 of the housing and the second, upper wall edges 121*q* of the walls of the light distributor 120, with a slight upward inclination, into the environment of the lighting device. The light distributor 120 is once again formed and dimensioned in such a way that all light radiated through directly or with at least one reflection by said light distributor makes an angle of at least 25° with the web plane 122. Furthermore, the strips 121*b* and the walls 121*i* formed by them ensure that no light radiated directly from the lamp 115 and no light radiated from the reflector 108 or another reflecting part of the housing 103 and the entire lighting device 101 is directed downward past the middle section 121*a*.

Figure 11:
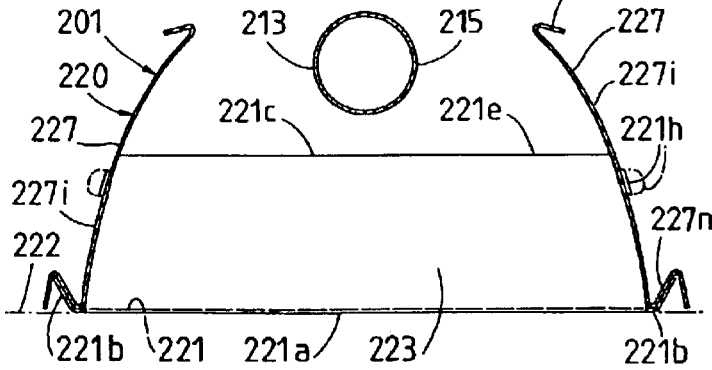
FIG. 11 shows a schematic cross-section through the light distributor and the lamp of still another lighting device, which cross-section is analogous to FIG. 2.
Figure 13:
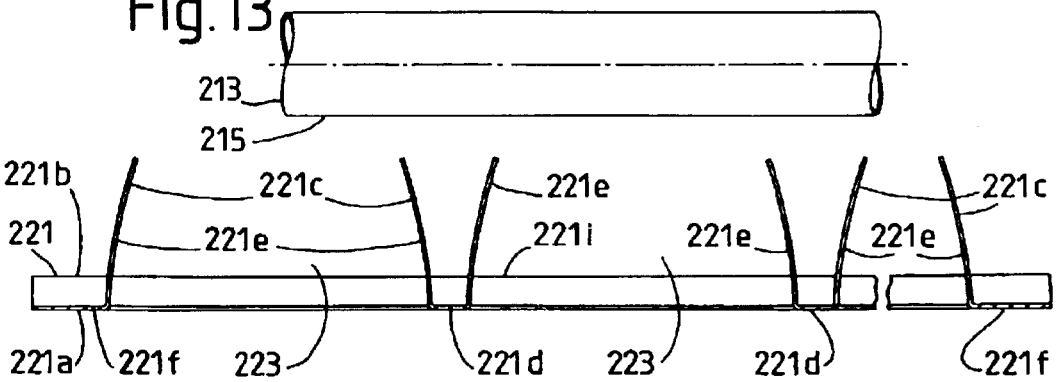
FIG. 13 shows a longitudinal section through the reflective lamella grid of the light distributor according to FIG. 11.
Figure 14:
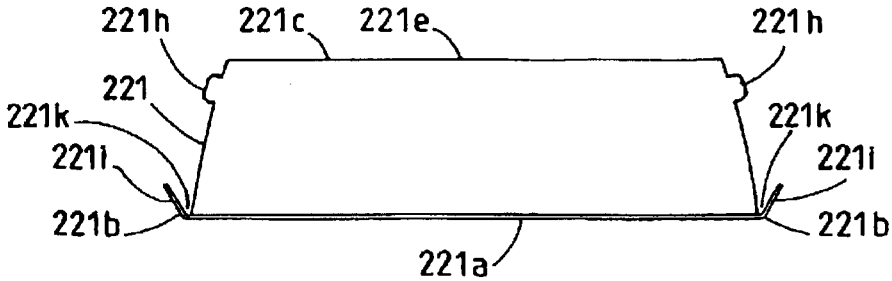
FIG. 14 shows an end view of the reflective lamella grid.

The lighting device 201 shown partly and in simplified form in FIG. 11 has a housing which is not shown and which holds an electric light source 213, comprising a tubular lamp 215, and a removable light distributor 220. In this embodiment, the light distributor 220 is composed of three originally separate, one-piece parts, namely sheet-metal pieces, i.e. a lamella grid or, more precisely, reflective lamella grid 221 and two lateral members 227. The one-piece reflective lamella grid 221 is also shown separately in FIGS. 13, 14 and 15 and once again has a middle section 221*a* and two strips 221*b*, each of which is arranged on one of the two longitudinal sides of the middle section. The middle section 221*a* has a row of lamellae which comprises a number of lamellae 221*c*. Each inner lamella 221*c* once again has an inner web 221*d* and two limbs 221*e*, the web once again being associated at its ends with one of the two strips 221*b* and, at its longitudinal or lateral edges running transversely to the row of lamellae, with the limbs. The width of the inner webs 221*d* may have values similar to those stated for the webs 21*d* and in particular may also be smaller than shown in FIGS. 13 and 15, in relation to the other dimensions of the reflective lamella grid 221. Each of the two end lamellae 221*c* present at one of the ends of the row of lamellae has an end web 221*f* and, for example, only one limb 221*e* associated with this. The limbs 221*e* of the lamellae 221*c* generally have shapes similar to those of the limbs 221*e* and, in particular in the section shown in FIG. 13 and running in the longitudinal direction of the row of lamellae, are, for example, curved similarly to the limbs 21*e*. Otherwise, the lateral edges of the limbs 221*e* are for the most part inclined upwards slightly toward one another and, for example at least for the most part, slightly convex, more or less similarly to the limbs 21*e*. The limbs 221*e* furthermore have a projecting fastening section 221*h*, i.e. a fastening lug 221*h* at each of their lateral edges.

The lower surfaces of the webs 221*d*, 221*f* once again define a web plane 222. Each strip 221*b* has a lateral section 221*i* which is shown particularly clearly in FIG. 12 and is angled and/or curved with respect to the web plane 222 and, as in the case of the limb 221*e* of the lamellae 221*c*, projects upward away from the web plane 222. The lateral sections 221*i* of the two strips 221*b* have flat main sections which are inclined outward away from one another and from the lamellae in the direction upward away from the web plane. The height of the lateral sections 221*i* which is measured perpendicular to the web plane 222 and starting from the latter is substantially smaller than the correspondingly measured height of the limbs of the lamellae. Each lateral section 221*i*, together with the lowermost regions of those lateral edges of the limbs 221*e* of the lamellae 221*c* which face said lateral section, bound a row of partial intermediate spaces which together form a more or less groove-like and/or incision-like intermediate space 221*k* which widens in cross-section upward away from the web plane 222 and is, for example, approximately V-shaped.

One of the two lateral members 227 is also shown separately in FIGS. 16, 17. Each lateral member 227 has a main section which forms a lateral wall 227*i* and/or a lateral reflector 227*i* of the light distributor 220. Each lateral member 227 furthermore has a retaining section 227*n* contiguous with the lower edge of the lateral wall 227*i*. Said retaining section has an inner limb 227*p* angled and/or curved upward away from the lower edge of the wall 227*i* and flat for the most part and an outer limb 227*r* contiguous with the upper edge of said limb 227*p* and once again angled and/or curved downward. The lowermost region of the wall 227*i* and the inner limb 227*p* of the retaining section 227*n* of each lateral member 227 project into the intermediate space 221*k* between one lateral edge of the limbs 221*e* of the lamellae and the lateral sections 221*i* of the reflective lamella grid 221 which are arranged there, so that each lateral member 227 touches the reflective lamella grid 221 in the relevant intermediate space 221*k*. At least the greatest parts of those regions of the walls 227*i* and retaining sections 227*n* of the lateral members which project into the intermediate spaces 221*k* fit at least approximately without play and tightly into the intermediate spaces 221*k*. The lateral walls 227*i* project upward away from the upper surfaces of the strips 221*b* of the reflective lamella grid 221 at least to the height of those upper ends of the limbs 221*e* of the lamellae 221*c* which form the highest points of the limbs 221*e* and namely beyond the upper ends of the limbs at least into the height range of the lamp 215. The height is measured from the web plane 222 perpendicular to the web plane 222. The walls 227*i* of the lateral members 227 have a slot-like hole 227*s* for each fastening section 221*h* consisting of a fastening lug 221*h*. The two lateral members also have for example, on the upper edges of the walls 221*i*, edge sections 227*t* angled and/or curved outward.

Figure 12:
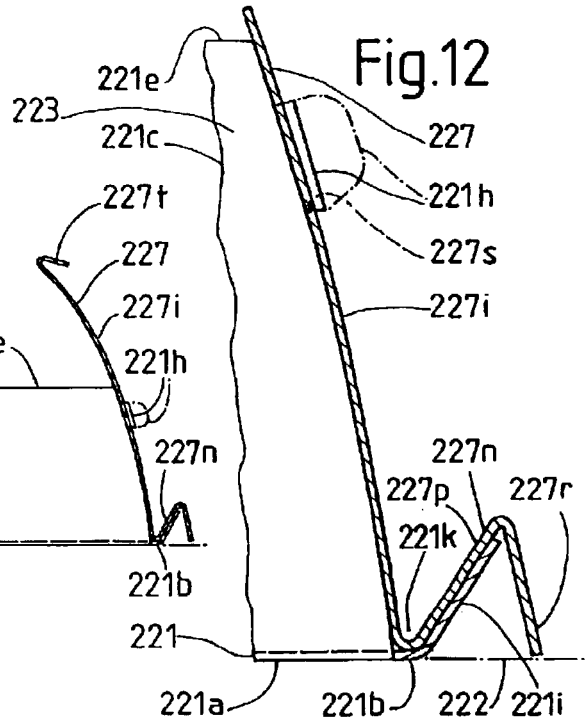
FIG. 12 shows a cut-out from FIG. 11, on a larger scale.

When the light distributor 220 is assembled, each of the two lateral members 227 is inserted from above into one of the groove-like intermediate spaces 221*k* bounded by the limbs 221*e* of the lamellae 221*c* and one of the lateral sections 221*i* of the reflective lamella grid 221. The fastening lugs 221*a* are also pushed through the coordinated slot-like holes 227*s*. The lateral members 227 are, for example, slightly springy so that they can be temporarily elastically deformed and more or less snap in on insertion into the groove-like intermediate spaces 221*k* of the reflective lamella grid 221 and when the fastening lugs 221*h* are pushed into the holes 227*s*. The lateral edges of the limbs 221*e* of the lamellae 221*c* then rest at least approximately against the walls 221*i*, whereby they touch these at least in part, and preferably rest at least approximately against them along their entire length. Furthermore, the transition regions which connect the lower ends of the walls 227*i* to the retaining sections 227*n*, and the inner limbs 227*p* of the retaining sections 227*n* rest at least in parts and, for example, for the most part against the strips 221*b* and the lateral sections 227*i* formed by their outermost parts. Moreover, the outer limbs 227*r* of the retaining sections 227*n* of the lateral members 227 grip around the free edges of the lateral sections 221*i*. The fastening lugs 221*h* are angled and/or curved after being pushed through the holes 227*s*, so that they are adjacent to the outside of the walls 227*i* at least in parts. FIGS. 11 and 12 show the shapes of the fastening lugs by dash-dot lines before being bent over and by solid lines after being bent over. When the fastening lugs have been bent over, they connect the walls 227*i* firmly to the limbs of the lamellae 221. Because of this and because of those parts of the lateral members 227 which fit into the groove-like intermediate spaces 221*k*, the entire lateral members 227 are connected firmly and stably to the reflective lamella grid 221. The edge section 227*t* of the lateral members 227 which is present at the upper edges of the walls 227*i* and projects outward away from said walls may serve for the detachable connection of the light distributor 220 to the housing which is not shown and which holds the lamp 215.

An intermediate light transmission space 223 which, in that cross-section of the light distributor which is shown in FIG. 11, is bounded on both sides by the walls 227*i* is present between the directly adjacent limbs 221*e* of different lamellae 221*c* following one another along the row of lamellae. The reflective lamella grid 221 and the two lateral members 227 once again consist, for example, of sheet-metal pieces comprising aluminum or of an aluminum alloy. The sheet-metal pieces once again have on both sides, for example, a smooth and light-reflective, mirror surface, one of these surfaces being made highly reflective and better reflecting than the other surface by a particular treatment, analogously to the manner described for the reflective lamella grid 21. The lower surfaces of the webs 221*d*, 221*f* and especially those surfaces of the limbs 221*e* of the lamellae of the reflective lamella grid 221 which are adjacent to the intermediate light transmission spaces 223 should then be highly reflective analogously to the reflective lamella grids 21 and 121. In the case of the two lateral members 227, at least that surface which forms the inner surfaces of the walls 221*i* is then highly reflective, said inner surfaces facing one another and the lamellae. Because the reflective lamella grid 221 and the two lateral elements 227 are produced from originally separate parts, it is possible to make the inner surfaces of the walls 227*i* highly reflective, although only one of the two surfaces of the sheet-metal pieces is highly reflective and although the walls have only one layer.

Unless stated otherwise above, the light devices 101, 201 and their light distributors 120 and 220, respectively, may be formed similarly and may have similar properties to the lighting device 1 and the light distributor 20.

The lighting devices and their light distributors may also be modified in other ways. In particular, features of the lighting devices 1, 101, 201 and their light distributors 20, 120, 220 can be combined with one another. The curved limbs 21*e* and 221*e* of the reflective lamella grids 21, 221 could, for example, be replaced by limbs which are flat in the same way as the limbs 121*e* of the reflective lamella grid 121. Conversely, the flat limbs 121*e* could be replaced by limbs curved analogously to the limbs 21*e*. Furthermore, a lighting device can have more than one lamp and/or more than one light distributor. The lighting device can furthermore be formed as a standard lamp having a stand or as a wall lamp for fastening to a wall. Moreover, the walls 21*i* of the reflective lamella grid 21 or at least the second, inner wall sections 21*m* of these walls may also be angled and/or curved in other parts in vertical cross-sections, in addition to the angled and/or curved transition 21*t*, in such a way as to form wall parts which are angled toward one another and whose reflective inner surfaces make an obtuse angle with one another. Furthermore, the walls 121*i* or at least the second, inner wall sections 121*m* of these walls may also each be angled and/or curved once or several times so that the reflective inner surfaces of the successive wall parts make an obtuse or possibly convex angle with one another in pairs in vertical cross-sections. In addition, the walls 21*i*, 121*i* or at least their second, inner wall sections 21*m*, 121*m* may have, at least in part, continuously and smoothly curved, concave, for example approximately parabolic inner surfaces in vertical cross-sections. The shapes of the lateral edges of the limbs 221*e* of the lamellae 221*c* and the cross-sectional shapes of the walls 227*i* can, for example, be formed and modified similarly to the light distributor 20. Furthermore, the top reflectors 8, 108, 208 may also be at least partly curved in such a way that their lower reflective surfaces, in vertical cross-sections, are at least in part continuously and smoothly convex and, for example, approximately parabolic. If both the top reflector 8 and at least the second, inner wall sections 21*m* of the walls 21*i* serving as lateral reflectors are curved in the lighting device 1 shown in FIGS. 1, 2, the reflective inner surfaces of the walls 21*i* may be at least approximately smoothly and continuously contiguous with the lower surface of the top reflector 8 so that these surfaces together form, for example, an approximately parabolic surface. The same applies to the top reflector of the lighting device 201, which reflector is not shown.

In the lighting device 101 shown in FIGS. 7, 8, the distribution of the light reflected by the walls 121*i* upward into the environment of the lighting device 101 and this light as a proportion of all light generated by the light source 113 can be influenced within wide limits by the shape and dimensions of the reflector 108 and of the walls 121*i* of the light distributor 120 and also by the distances of the reflector 108 and of the light distributor 120 from one another and from the lamp.

That part of the light which is radiated from the lamps 15, 115, 215 of the light sources 13, 113, 213, directly or after at least one reflection, through the intermediate light transmission spaces 23, 123, 223 of the light distributor 20, 120, 220 may be at least 30% and preferably at least about 40% of the total quantity of light generated by the light sources 13, 113, 213, in all lighting devices 1, 101, 201. In the lighting devices 1, 201 described with reference to FIGS. 1 to 6 and 11 to 17, said part of the light is even preferably at least 50%, and for example at least or about 70% of the total quantity of light generated by the light source 13 or 213, or even more.

The light distributors may furthermore be produced from sheet-metal pieces where both surfaces are highly reflective and mirror-like and in particular also equally well light-reflecting. Particularly in this case, the second, inner wall sections 21*m*, 121*m* of the walls 21*i*, 121*i*, can be omitted and the latter can be formed as a single layer. In the light distributors 20, 220, the fastening sections 21*h*, 221*h* could be omitted in a part of the limbs 21*e*, 221*e* of the lamellae. The fastening sections could also be provided with incisions so that they have hook-like shapes and/or could be locked to the walls 21*i* or 227*i*. Furthermore, the limbs of the lamellae could also have, at their upper ends, angled end sections which are directed away from the intermediate transmission space adjacent to the relevant limb and are, for example, approximately parallel or slightly inclined to the web plane 22 or 122. These end sections of the limbs can then at least partly reflect light radiated directly from the lamp or from the reflector toward them so that, after further reflections by the reflector and/or by the lamellae, it is also radiated downward through the intermediate light transmission spaces and out of the light distributor. Moreover, a light distributor could have two or even more rows of lamellae which run parallel to one another side by side and between which a strip associated with the webs of the lamellae is present. Furthermore, the end lamellae present at the two ends of a row of lamellae could also have two limbs projecting from their web.

In the case of the reflective lamella grid 221, the strips 221*b* and their lateral sections 221*i* could be modified, for example, in such a way that the groove-like intermediate spaces 221*k* have a substantially flat base parallel to the web plane 222 and are more or less U-shaped and/or trapezoidal and, for example, also widen slightly in an upward direction. Furthermore, the outer limbs 227*r* angled downward could be replaced by, for example, edge sections possibly multiply angled and/or curved outward and/or upward.

The middle section 21*a* and/or 121*a* and/or 221*a* of the reflective lamella grid 21 or 121 or 221, respectively, could even be modified in such a way that the limbs of the lamellae run downward away from the webs and from the light source. In the case of the lamellae having two limbs, the two limbs belonging to the same lamella would then be inclined downward toward one another in a direction away from the webs. Furthermore, the positions and shapes of the strips 21*b* or 121*b* or 221*b* and of the lateral walls would, if necessary, have to be modified with respect to the middle sections 21, 121*a*.

What is claimed is:

1. A light distributor for a lighting device, comprising at least one row of lamellae which is arranged between two strips parallel to one another and has two end lamellae arranged at one end each of said row and inner lamellae arranged between said end lamellae, the strips and lamellae together consisting of a single sheet-metal piece, each lamella having a web associated with the two strips and at least each inner lamella having two limbs which are opposite one another, associated with the web of the relevant lamella and at least one of angled and curved away from the web wherein the webs together define a web plane, all limbs projecting on the same side of said plane, and the two strips have lateral sections which make an angle with the web plane and run away from the webs on the same side of the web plane as the limbs, wherein each lateral section forms a wall having a first wall section and a second wall section, wherein the first wall section is associated with the webs at a first wall edge, one of directly and via a strip-like connecting section, and with the second wall section at a second wall edge, and wherein the wall is folded at the second wall edge in such a way that the second wall section runs toward the webs from the second wall edge on that side of the first wall section which faces the other wall.

2. The light distributor as claimed in claim 1, wherein each end lamella has at least one limb associated with its web.

3. The light distributor as claimed in claim 1, wherein the second wall section is at least in parts at least approximately adjacent to the first wall section.

4. The light distributor as claimed in claim 1, wherein the limbs following one another along the at least one row of lamellae and belonging to different lamellae have light-reflecting surfaces facing one another and wherein the walls have light-reflecting surfaces facing one another and the limbs of the lamellae.

5. The light distributor as claimed in claim 4, wherein said light-reflecting surfaces of the limbs and walls are smooth and mirror-like.

6. The light distributor as claimed in claim 4, wherein said light-reflecting surfaces of the limbs and walls are provided with a light-transmitting protective layer.

7. The light distributor as claimed in claim 1, wherein the walls project to a height which is measured from the web plane and perpendicular to the latter and which is at least at a correspondingly measured height of a highest point of the limbs of the lamellae.

8. The light distributor as claimed in claim 1, wherein the walls project to a height which is measured from the web plane and perpendicular to the latter and which is above the highest point of the limbs of the lamellae.

9. The light distributor as claimed in claim 1, wherein each limb has two lateral limb edges which face away from one another and run away from the web associated with this limb, and wherein at least some of the limbs have, at their lateral limb edges, a fastening section which passes through a hole in one of the walls and connects the limb firmly to the relevant wall.

10. The light distributor as claimed in claim 9, wherein, on that side of the wall which faces away from the remaining part of the limb, each fastening section is at least one of angled and curved and locked to the wall.

11. The light distributor as claimed in claim 1, wherein the two limbs associated with the same web are one of inclined away from one another and inclined toward one another in a direction away from this web.

12. The light distributor as claimed in claim 1, wherein the two limbs of each inner lamella associated with the same web are inclined away from one another in a direction away from this web and are curved in a section approximately perpendicular to the web plane in such a way that the opposite surfaces of two limbs belonging to lamellae adjacent to one another are concave.

13. A light distributor for a lighting device, comprising at least one row of lamellae which is arranged between two strips parallel to one another and has two end lamellae arranged at one end each of said row and inner lamellae arranged between said end lamellae, the strips and lamellae together consisting of a single sheet-metal piece, each lamella having a web associated with the two strips and at least each inner lamella having two limbs which are opposite one another, associated with the web of the relevant lamella and at least one of angled and curved away from the web wherein the webs together define a web plane, all limbs projecting on the same side of said plane, wherein, in addition to the sheet-metal piece forming the strips and lamellae, two originally separate lateral members are also present which run along the strips, each touch one the strips, are firmly connected to the sheet-metal piece forming the strips and lamellae and form walls which make an angle with the web plane and are present at least in part on the same side of the web plane as the limbs of the lamellae.

14. The light distributor as claimed in claim 13, wherein each lateral member consists of a sheet-metal piece.

15. The light distributor as claimed in claim 13, wherein the two strips have lateral sections which make an angle with the web plane and run away from the webs on the same side of the web plane as the limbs and wherein each lateral member has a retaining section which is at least one of angled and curved away from the wall formed by this lateral member and which rests at least in parts against the lateral section of one of the strips.

16. The light distributor as claimed in claim 13, wherein the limbs following one another along the at least one row of lamellae and belonging to different lamellae have light-reflecting surfaces facing one another and wherein the walls have light-reflecting surfaces facing one another and the limbs of the lamellae.

17. The light distributor as claimed in claim 16, wherein said light-reflecting surfaces of the limbs and walls are smooth and mirror-like.

18. The light distributor as claimed in claim 16, wherein said light-reflecting surfaces of the limbs and walls are provided with a light-transmitting protective layer.

19. The light distributor as claimed in claim 13, wherein the walls project to a height which is measured from the web plane and perpendicular to the latter and which is at least at a correspondingly measured height of a highest point of the limbs of the lamellae.

20. The light distributor as claimed in claim 13, wherein the walls project to a height which is measured from the web plane and perpendicular to the latter and which is above a highest point of the limbs of the lamellae.

21. The light distributor as claimed in claim 13, wherein each limb has two lateral limb edges which face away from one another and run away from the web associated with this limb, and wherein at least some of the limbs have, at lateral limb edges, a fastening section which passes through a hole in one of the walls and connects the limb firmly to the relevant wall.

22. The light distributor as claimed in claim 21, wherein, on that side of the wall which faces away from the remaining part of the limb, each fastening section is at least one angled and curved and locked to the wall.

23. The light distributor as claimed in claim 1, wherein the light distributor is formed and dimensioned in such a way that all light radiated through it from a light incidence side makes an angle of at least 25° with said web plane.

24. The light distributor as claimed in claim 13, wherein each end lamella has at least one limb associated with its web.

25. A lighting device comprising at least one light distributor as claimed in claim 24, wherein the lighting device has at least one lamp holder holding at least one electric lamp of a light source in such a way that the light source radiates light through the light distributor during operation.

26. The light distributor as claimed in claim 13, wherein the two limbs associated with the same web are one of inclined away from one another and inclined toward one another in a direction away from this web.

27. The light distributor as claimed in claim 13, wherein the two limbs of each inner lamella associated with the same web are inclined away from one another in a direction away from this web and are curved in a section approximately perpendicular to the web plane in such a way that the opposite surfaces of two limbs belonging to lamellae adjacent to one another are concave.

28. The light distributor as claimed in claim 13, wherein the light distributor is formed and dimensioned in such a way that all light radiated through it from a light incidence side makes an angle of at least 25° with said web plane defined by the webs.

29. A light distributor for a lighting device, comprising at least one row of lamellae which is arranged between two strips parallel to one another and has two end lamellae arranged at one end each of said row and inner lamellae arranged between said lamellae, each lamella having a web associated with the two strips, at least each inner lamella having two limbs which are opposite one another, associated with the web of the relevant lamella and at least one of angled and curved away from the web, wherein the webs together define a web plane, all limbs projecting on the same side of said plane, wherein the two strips form walls which make an angle with the web plane, run away from the webs on the same side of the web plane as the limbs, wherein the lamellae and the strips including said walls together consist of a single sheet-metal piece, and wherein said sheet-metal piece has two surfaces which are both light-reflecting so that the limbs following one another along the at least one row of lamellae and belonging to different lamellae have light-reflecting surfaces facing one another and that the walls have light-reflecting surfaces facing one another and the limbs of the lamellae.

30. The light distributor as claimed in claim 29, wherein said light-reflecting surfaces of the sheet-metal piece are smooth and mirror-like.

31. The light distributor as claimed in claim 29, wherein said light-reflecting surfaces of the sheet-metal piece are provided with a light-transmitting protective layer.

32. The light distributor as claimed in claim 29, wherein each end lamella has at least one limb associated with its web.

33. The light distributor as claimed in claim 29, wherein the two limbs associated with the same web are one of inclined away from one another and inclined toward one another in a direction away from this web.

34. The light distributor as claimed in claim 29, wherein the two limbs of each inner lamella associated with the same web are inclined away from one another in a direction away from this web and are curved in a section approximately perpendicular to the web plane in such a way that the opposite surfaces of two limbs belonging to lamellae adjacent to one another are concave.

35. The light distributor as claimed in claim 29, wherein the light distributor is formed and dimensioned in such a way that all light radiated through it from a light incidence side makes an angle of at least 25° with said web plane.

36. The light distributor as claimed in claim 29, each wall is formed on a single layer of the sheet-metal piece.

37. A method for the production of a light distributor for a lighting device, comprising at least one row of lamellae which is arranged between two strips parallel to one another and has two end lamellae arranged at one end each of said row and inner lamellae arranged between said end lamellae, each lamella having a web associated with the two strips, at least each inner lamella having two limbs which are opposite one another, associated with the web of the relevant lamella and at least one of angled and curved away from the web, wherein the webs together define a web plane, all limbs projecting on the same side of said plane, wherein the two strips form walls which make an angle with the web plane, run away from the webs on the same side of the web plane as the limbs, wherein the lamellae and the strips including said walls together consist of a single sheet-metal piece, wherein the sheet-metal piece has two surfaces which are both light-reflecting so that the limbs following one another along the at least one row of lamellae and belonging to different lamellae have light-reflecting surfaces facing one another and that the walls have light-reflecting surfaces facing one another and the limbs of the lamellae, wherein a fiat sheet-metal piece is provided with at least one of cuts and holes for bounding two lateral limb edges facing away from one another and an end limb edge for each limb, wherein the limbs thus bounded are angled relative to the web plane, and wherein the walls formed by the two strips are one of angled and folded relative to the web plane.

38. The method as claimed in claim 37, wherein the two limbs associated with the same web are one of inclined away from one another and inclined toward one another in a direction away from this web.

39. The method as claimed in claim 37, wherein the two limbs of each inner lamella associated with the same web are inclined away from one another in a direction away from this web and are curved in a section approximately perpendicular to the web plane in such a way that the opposite surfaces of two limbs belonging to lamellae adjacent to one another are concave.

40. The method as claimed in claim 37, wherein the light distributor is formed and dimensioned in such a way that all light radiated through it from a light incidence makes an angle of at least 25° with the web plane.

41. The method as claimed in claim 37, wherein said light-reflecting surfaces are smooth and mirror-like.

42. The method as claimed in claim 37, wherein said light-reflecting surfaces are provided with a light-transmitting protective layer.

43. The method as claimed in claim 37, wherein each wall is formed as single layer of the sheet-metal piece.

* * * * *